US006662838B1

(12) United States Patent
Graham, III

(10) Patent No.: US 6,662,838 B1
(45) Date of Patent: Dec. 16, 2003

(54) BENCH SLIDE MOUNT

(76) Inventor: Frank L. Graham, III, 39048 Robert Cir., Cathedral City, CA (US) 92234

( * ) Notice: Subject to any disclaimer, the term of this patent is extended or adjusted under 35 U.S.C. 154(b) by 0 days.

(21) Appl. No.: 10/285,607

(22) Filed: Oct. 30, 2002

(51) Int. Cl.[7] ..... B25H 1/00

(52) U.S. Cl. ..... 144/286.5; 83/564; 108/38; 108/40; 108/147.2; 144/48.7; 144/286.1; 312/323

(58) Field of Search ..... D6/428; 83/564; 108/38, 40, 144.11, 145, 147.11, 147.19, 147.2; 144/1.1, 48.3, 48.7, 286.1, 286.5; 248/274.1, 276.1, 278.1, 309; 312/322, 323, 223.1, 298

(56) References Cited

U.S. PATENT DOCUMENTS

| | | | | | |
|---|---|---|---|---|---|
| 2,712,484 | A | * | 7/1955 | Adolphson | 108/40 |
| 5,067,535 | A | * | 11/1991 | Wolff | 14/286.1 |
| 5,873,433 | A | * | 2/1999 | Katz | 182/129 |
| 6,193,341 | B1 | * | 2/2001 | Eizadkhah | 312/323 |
| 2003/0057340 | A1 | * | 3/2003 | Mann et al. | 248/274.1 |

* cited by examiner

*Primary Examiner*—W. Donald Bray

(57) ABSTRACT

A bench slide mount is provided, comprising a flat rectangular plate with roller slides connected to its sides, and two hinges connecting the plate to an L-shaped bench mount bracket. The bench slide mount has particular utility in connection with coupling tools to a workbench for operational use of the tools, with a unique capability to extend, pivot, and rotate for storing the tools below the workbench.

20 Claims, 3 Drawing Sheets

BENCH SLIDE MOUNT

BACKGROUND OF THE INVENTION

1. Field of the Invention

The present invention relates to a bench slide mount for use in connection with a workbench. The bench slide mount has particular utility in connection with coupling tools to a workbench, with a unique capability to extend, pivot, and rotate for storing the tools below the workbench.

2. Description of the Prior Art

Bench slide mounts are desirable for coupling tools to a workbench, with a capability to extend, pivot, and rotate for storing the tools below the workbench.

The use of workbenches and worktables is known in the prior art. For example, U.S. Pat. No. 6,148,881 to Valenzuela discloses a workbench. However, the Valenzuela '881 patent does not provide a bench slide mount that allows the coupling of tools to a workbench, with a capability to extend, pivot, and rotate for storing the tools below the workbench.

U.S. Pat. No. 3,993,008 to Parsons, Sr. discloses a power lift for a sewing machine head. However, the Parsons, Sr. '008 patent does not provide a bench slide mount that allows the coupling of tools to a workbench, with a capability to extend, pivot, and rotate for storing the tools below the workbench.

U.S. Pat. No. Des. 394,761 to Bird et al. discloses a workbench. However, the Bird '761 patent does not provide a bench slide mount that allows the coupling of tools to a workbench, with a capability to extend, pivot, and rotate for storing the tools below the workbench.

U.S. Pat. No. 5,366,071 to Laszlo discloses a combined workbench and carry-case. However, the Laszlo '071 patent does not provide a bench slide mount that allows the coupling of tools to a workbench, with a capability to extend, pivot, and rotate for storing the tools below the workbench.

U.S. Pat. No. 5,067,535 to Wolff discloses a worktable. However, the Wolff '535 patent does not provide a bench slide mount that allows the coupling of tools to a workbench, with a capability to extend, pivot, and rotate for storing the tools below the workbench.

Lastly, U.S. Pat. No. 2,712,484 to Adolphson discloses a physician's examining table. However, the Adolphson '484 patent does not provide a bench slide mount that allows the coupling of tools to a workbench, with a capability to extend, pivot, and rotate for storing the tools below the workbench.

While the above-described devices fulfill their respective, particular objectives and requirements, the aforementioned patents do not describe a bench slide mount that allows the coupling of tools to a workbench, with a capability to extend, pivot, and rotate for storing the tools below the workbench. The prior art patents make no provision for an apparatus that extends, pivots, and rotates for storing tools below the workbench.

Therefore, a need exists for a new and improved bench slide mount that can be used for coupling tools to a workbench, with a capability to extend, pivot, and rotate for storing the tools below the workbench. In this regard, the present invention substantially fulfills this need. In this respect, the bench slide mount according to the present invention substantially departs from the conventional concepts and designs of the prior art, and in doing so provides an apparatus primarily developed for the purpose of coupling tools to a workbench, with a unique capability to extend, pivot, and rotate for storing the tools below the workbench.

SUMMARY OF THE INVENTION

In view of the foregoing disadvantages inherent in the known types of workbenches and worktables now present in the prior art, the present invention provides an improved bench slide mount, and overcomes the above-mentioned disadvantages and drawbacks of the prior art. As such, the general purpose of the present invention, which will be described subsequently in greater detail, is to provide a new and improved bench slide mount and method which has all the advantages of the prior art mentioned heretofore and many novel features that result in a bench slide mount which is not anticipated, rendered obvious, suggested, or even implied by the prior art, either alone or in any combination thereof.

To attain this, the present invention essentially comprises a bench slide mount, comprising a plate having a front side, a rear side, a left side and a right side, a left roller slide connected to the left side of the plate, a right roller slide connected to the right side of the plate, at least one hinge connected to the front side of the plate, and an L-shaped bench mount bracket connected to the hinge.

In one embodiment, the present invention comprises a bench slide mount, comprising a substantially flat substantially rectangular plate having a front side, a rear side, a left side and a right side, a left roller slide connected to the left side of the plate, a right roller slide connected to the right side of the plate, two hinges connected to the front side of the plate, and an L-shaped bench mount bracket connected to the hinges.

In another embodiment, the present invention comprises a bench slide mount, comprising a substantially flat substantially rectangular plate having a front side, a rear side, a left side and a right side, a pair of rollers connected to the left side of the plate, a pair of rollers connected to the right side of the plate, two side rails with each rail comprising a plurality of mounting holes and a channel configured to fit the rollers, wherein each channel holds a pair of the rollers therein, two hinges connected to the front side of the plate, and an L-shaped bench mount bracket connected to the hinges.

In yet another embodiment, the present invention comprises a bench slide mount, comprising a substantially flat substantially rectangular plate having a front side, a rear side, a left side and a right side, a pair of rollers connected to the left side of the plate, a pair of rollers connected to the right side of the plate, two side rails with each rail comprising a plurality of mounting holes and a channel configured to fit the rollers, wherein each channel holds a pair of the rollers therein, two hinges connected to the front side of the plate, an L-shaped bench mount bracket connected to the hinges, a tool connected to the bench mount bracket, and a work surface to which the side rails are mounted, such that the bench slide mount couples the tool to the work surface, and extends, pivots, and rotates to store the tool below the work surface.

There has thus been outlined, rather broadly, the more important features of the invention in order that the detailed description thereof that follows may be better understood and in order that the present contribution to the art may be better appreciated.

The invention may also include a tool, a workbench, and various attachments. There are of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bench slide mount that has all of the advantages of the prior art workbenches and worktables and none of the disadvantages.

It is another object of the present invention to provide a new and improved bench slide mount that may be easily and efficiently manufactured and marketed.

An even further object of the present invention is to provide a new and improved bench slide mount that has a low cost of manufacture with regard to both materials and labor, and which accordingly is then susceptible of low prices of sale to the consuming public, thereby making such bench slide mount economically available to the buying public.

Still another object of the present invention is to provide a new bench slide mount that provides in the apparatuses and methods of the prior art some of the advantages thereof, while simultaneously overcoming some of the disadvantages normally associated therewith.

Even still another object of the present invention is to provide a bench slide mount for coupling tools to a workbench. This allows the tools to be ready for use whenever needed.

Still yet another object of the present invention is to provide a bench slide mount for coupling tools to a workbench, with a unique capability to extend, pivot, and rotate for storing the tools below the workbench. This makes it possible to conveniently store the tools out of the way while still keeping the tools ready and available for use when needed.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
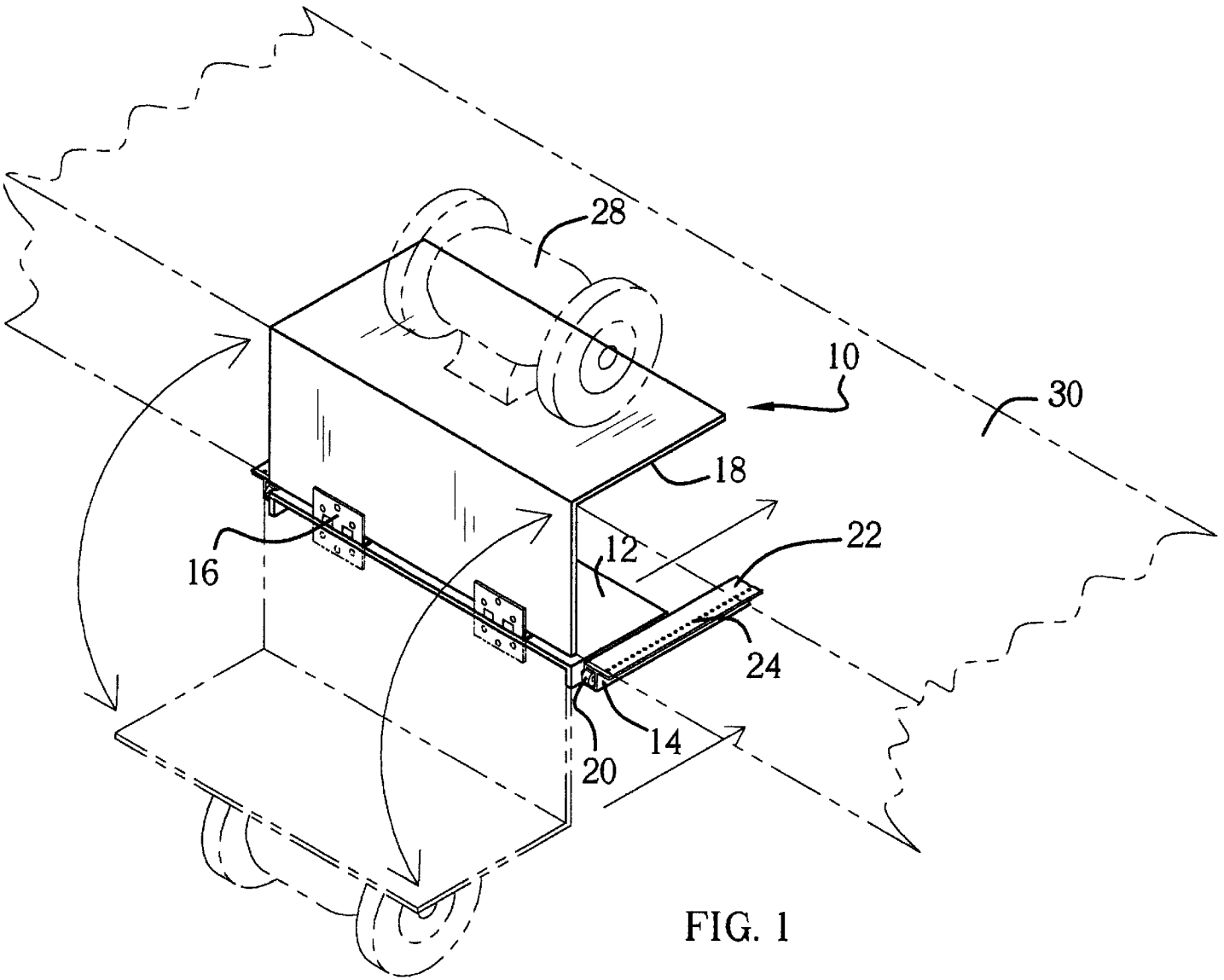
FIG. 1 is an isometric perspective view of the preferred embodiment of the bench slide mount constructed in accordance with the principles of the present invention, and illustrates the bench slide mount coupling a tool to a workbench for operational use and rotating under the workbench for storage of the tool.
Figure 2:
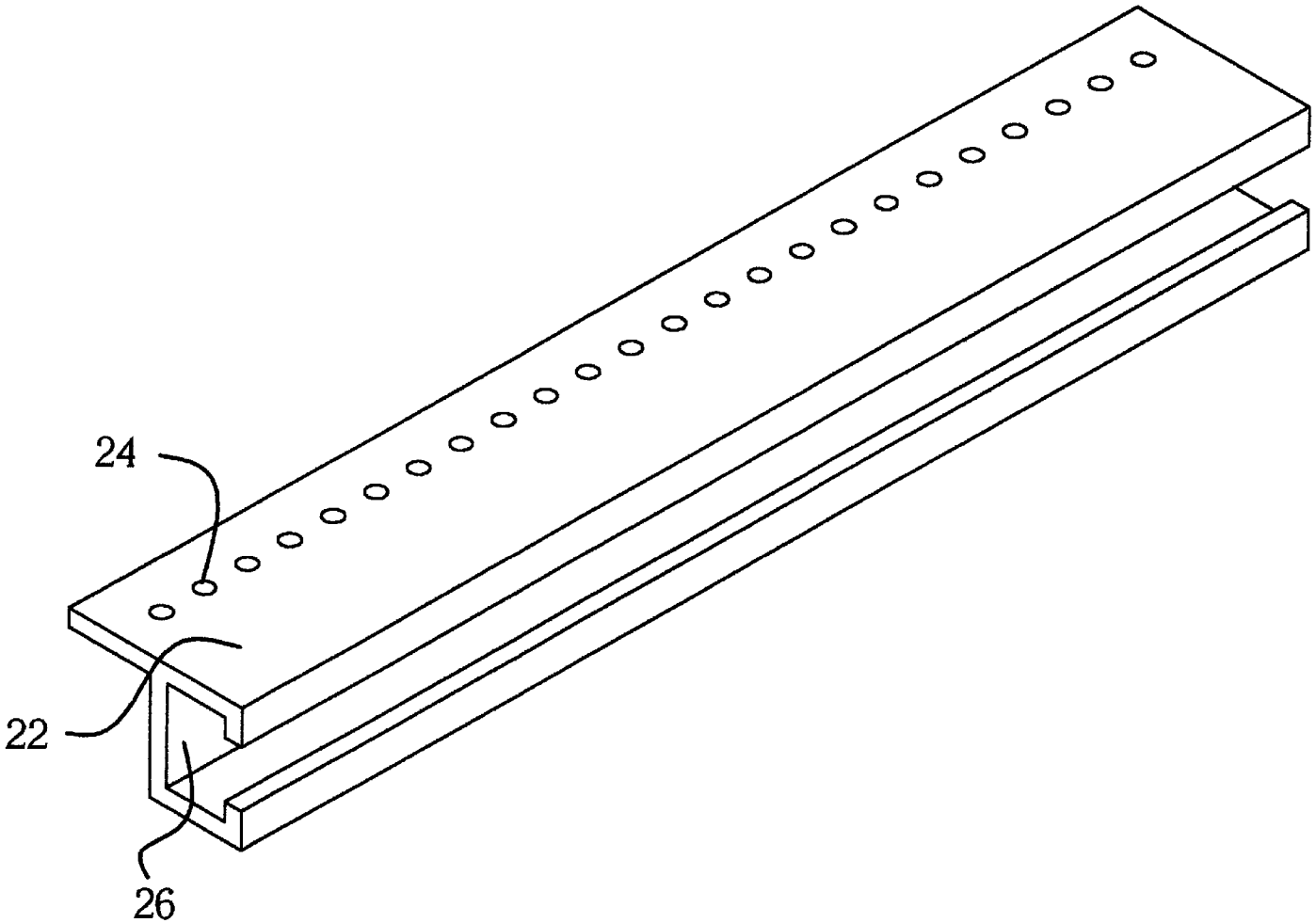
FIG. 2 is an isometric perspective view of the side rail of the bench slide mount of the present invention.
Figure 3:
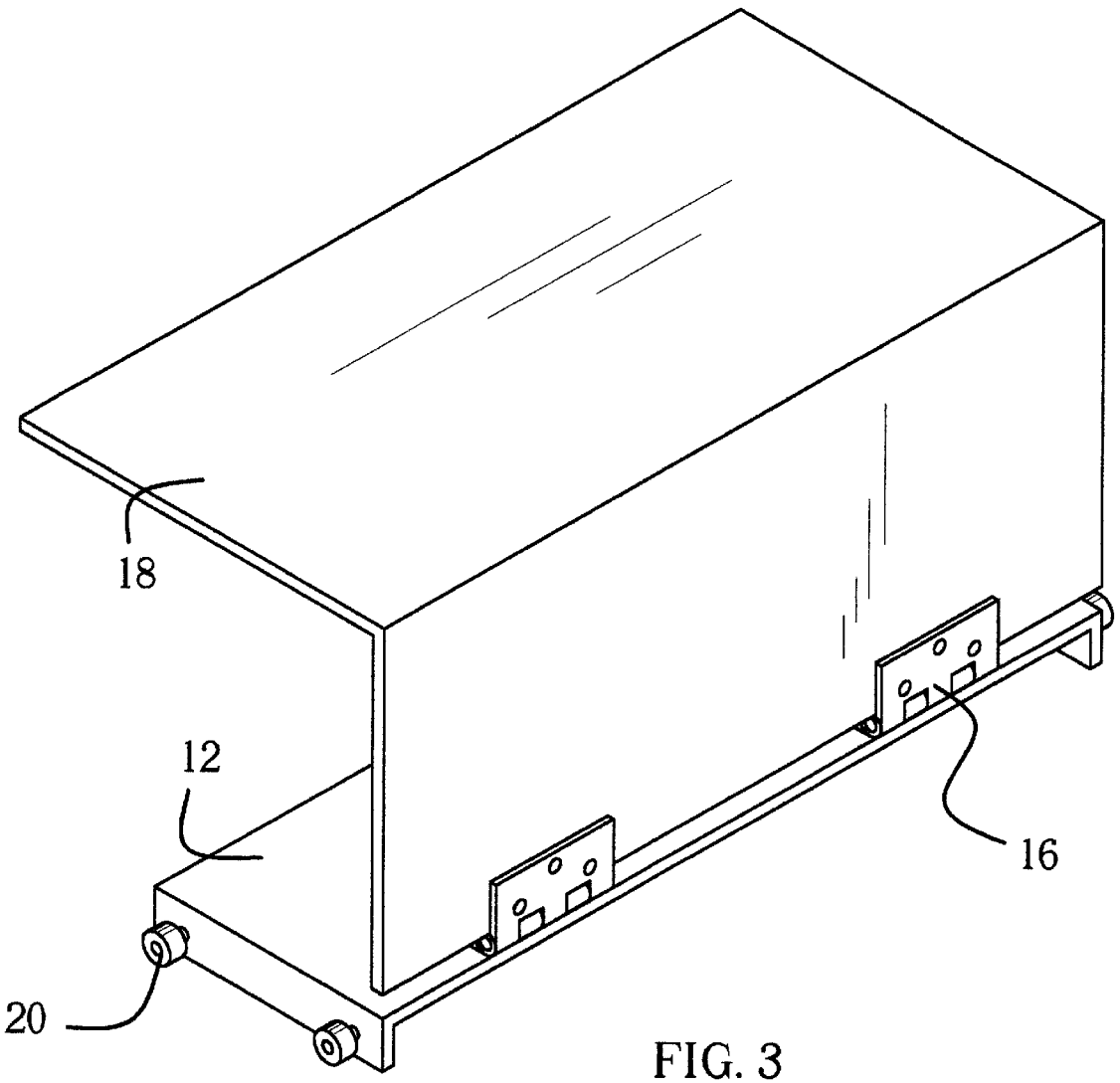
FIG. 3 is an isometric perspective view of the bench slide mount of the present invention without the side rails.

Referring now to the drawings, and particularly to FIGS. 1–3, a preferred embodiment of the bench slide mount of the present invention is shown and generally designated by the reference numeral 10.

In FIG. 1, a new and improved bench slide mount 10 of the present invention for coupling a tool 28 to a workbench 30, with a unique capability to extend, pivot, and rotate for storing the tool 28 below the workbench 30, is illustrated and will be described. More particularly, the bench slide mount 10 comprises a substantially flat substantially rectangular plate 12 having a front side, a rear side, a left side and a right side, and roller slides 14 connected to the left side and the right side of the plate 12. The roller slides 14 comprise a pair of rollers 20 connected to the plate 12 and a side rail 22 comprising a plurality of mounting holes 24 and a channel configured to fit the rollers 20, wherein the channel holds the rollers 20 therein. Two hinges 16 connect the front side of the plate 12 to an L-shaped bench mount bracket 18. The bench slide mount 10 couples a tool 28 to a workbench 30 for operational use, and the bench slide mount 10 extends, pivots, and rotates under the workbench 30 for storage of the tool 28.

FIG. 2 is an isometric perspective view of the side rail of the bench slide mount of the present invention, and illustrates the side rail 22 with mounting holes 24 and channel 26 configured to hold the rollers.

FIG. 3 is an isometric perspective view of the bench slide mount of the present invention without the side rails, and illustrates the plate 12, rollers 20 connected to the plate 12, and hinges 16 connecting the plate 12 to the L-shaped bench mount bracket 18.

The bench slide mount of the present invention is a special sliding mounting bracket for bench-mounted power tools, such as miter saws, grinders, etc. After an individual has finished a task, he or she can simply move the tool and upper section of the bracket forward toward the front of the workbench, thus permitting the tool and upper part of the bracket to swing downward. Since the lower part of the bracket, in essence, comprises a flat plate and a set of roller slides, the tool can be simply moved underneath the bench for storage.

Different embodiments of the bench mount bracket comprise more than one size and slightly different configurations, corresponding to the type of tool with which they are designed to be used. For example, the upper part of the bracket for a miter saw in one embodiment measures about 7 inches in length and comprises an L-shaped crosssection similar to a section of steel angle with unequal legs. During use of the saw, the longer leg serves as the mounting plate for the saw. In this embodiment, this longer leg measures about 8 inches in depth, and the shorter leg rests against the front edge of the bench and measures about 7 inches in height.

In this embodiment, the lower edge of the smaller leg is hinged to a flat plate, with the ends of this plate mounted on a set of roller slides. These roller slides comprise rollers within channels of side rails connected to the bench by screws or bolts through a plurality of mounting holes in the side rails. In one embodiment, the side rails for these slides are similar to the steel angle posts normally used for heavy-duty shelving in commercial buildings.

The bench slide mount of the present invention fulfills the need for an easy method for temporarily storing bench-mounted power tools. The appealing features of the bench slide mount include its convenience, ease of use, relatively light weight nature, ease of installation, time saving nature, optimum size, reasonable price, and ability to allow an individual to store bench-mounted power tools underneath a workbench when not being used, instead of leaving them bolted to the bench. This apparatus has utility for professional woodworkers, do-it-yourselfers, and others. Different embodiments of the bench slide mount such as various sizes make it appealing to a wide range of end users for a wide range of power tools.

The hinges may be connected to the bench mount bracket and the plate with screws, bolts, or any other suitable attachment. The side rails may be connected to the bench with screws, bolts, clamps, or any other suitable attachment. Likewise, the tool may be connected to the bench mount bracket with screws, bolts, clamps, or any other suitable attachment. Latches, hooks, or other additional attachments may be used to stabilize the bench slide mount in the work position and in the storage position.

The bench slide mount of the present invention is produced easily using conventional and readily available materials and manufacturing processes. No new production technology is required. The main parts of the bracket are fabricated from standard structural steel shapes. The slide mechanisms and the hinges are readily available off-the-shelf items.

In one embodiment, the bench slide mount of the present invention comprises a mounting system for coupling tools to a workbench, such that the mounting system has a unique capability to extend, pivot and rotate for storing tools below a workbench utilizing a unique track system, thereby to subsequently present them adjacent to and above a work surface during operational use.

In use, it can now be understood that the bench slide mount of the present invention has particular utility in connection with coupling tools to a workbench, with a unique capability to extend, pivot, and rotate for storing the tools below the workbench.

While a preferred embodiment of the bench slide mount has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as any metal, plastic, composite material, or a variety of wood may be used instead of the steel described. Also, the roller slides may be made of heavy-duty plastic, metal, rubber, composite material, or similar material, or combinations thereof. And although coupling tools to a workbench with a unique capability to extend, pivot, and rotate for storing the tools below the workbench has been described, it should be appreciated that the bench slide mount herein described is also suitable for use with counters and tables and items such as sewing machines and kitchen appliances. Furthermore, a wide variety of configurations may be used instead of those described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bench slide mount, comprising:

a plate having a front side, a rear side, a left side and a right side;

a left roller slide connected to said left side of said plate;

a right roller slide connected to said right side of said plate;

at least one hinge connected to said front side of said plate; and an L-shaped bench mount bracket connected to said hinge.

2. The bench slide mount of claim 1, wherein said plate is substantially flat and substantially rectangular.

3. The bench slide mount of claim 1, comprising two hinges connecting said plate to said L-shaped bench mount bracket.

4. The bench slide mount of claim 1, wherein each said roller slide comprises at least one roller and a side rail comprising a plurality of mounting holes and a channel configured to fit said roller, wherein said channel holds said roller therein.

5. The bench slide mount of claim 1, further comprising a tool connected to said bench mount bracket.

6. The bench slide mount of claim 1, further comprising a workbench having a top side and an underside wherein said roller slides are connected to said underside of said workbench.

7. The bench slide mount of claim 1, further comprising a tool and a work surface, wherein said bench slide mount couples said tool to said work surface for operational use of said tool.

8. The bench slide mount of claim 1, further comprising a tool and a work surface, wherein said bench slide mount couples said tool to said work surface, and extends, pivots, and rotates to store said tool below said work surface.

9. A bench slide mount, comprising:

a substantially flat substantially rectangular plate having a front side, a rear side, a left side and a right side;

a left roller slide connected to said left side of said plate;

a right roller slide connected to said right side of said plate;

two hinges connected to said front side of said plate; and an L-shaped bench mount bracket connected to said hinges.

10. The bench slide mount of claim 9, wherein each said roller slide comprises a pair of rollers and a side rail comprising a plurality of mounting holes and a channel configured to fit said rollers, wherein said channel holds said rollers therein.

11. The bench slide mount of claim 9, further comprising a tool connected to said bench mount bracket.

12. The bench slide mount of claim 9, further comprising a workbench having a top side and an underside wherein said roller slides are connected to said underside of said workbench.

13. The bench slide mount of claim 9, further comprising a tool and a work surface, wherein said bench slide mount couples said tool to said work surface for operational use of said tool.

14. The bench slide mount of claim 9, further comprising a tool and a work surface, wherein said bench slide mount couples said tool to said work surface, and extends, pivots, and rotates to store said tool below said work surface.

15. A bench slide mount, comprising:

a substantially flat substantially rectangular plate having a front side, a rear side, a left side and a right side;

a pair of rollers connected to said left side of said plate;

a pair of rollers connected to said right side of said plate;

two side rails, each said rail comprising a plurality of mounting holes and a channel configured to fit said rollers, wherein each channel holds a pair of said rollers therein;

two hinges connected to said front side of said plate; and an L-shaped bench mount bracket connected to said hinges.

16. The bench slide mount of claim 15, further comprising a tool connected to said bench mount bracket.

17. The bench slide mount of claim 15, further comprising a workbench having a top side and an underside wherein said side rails are connected to said underside of said workbench.

18. The bench slide mount of claim 15, further comprising a tool and a work surface, wherein said bench slide mount couples said tool to said work surface for operational use of said tool.

19. The bench slide mount of claim 15, further comprising a tool and a work surface, wherein said bench slide mount couples said tool to said work surface, and extends, pivots, and rotates to store said tool below said work surface.

20. The bench slide mount of claim 15, comprising steel.

* * * * *